US008842848B2

(12) United States Patent
Donaldson et al.

(10) Patent No.: US 8,842,848 B2
(45) Date of Patent: Sep. 23, 2014

(54) MULTI-MODAL AUDIO SYSTEM WITH AUTOMATIC USAGE MODE DETECTION AND CONFIGURATION CAPABILITY

(75) Inventors: Thomas A. Donaldson, San Francisco, CA (US); Alexander M. Asseily, London (GB); William Zissou Limpkin, London (GB)

(73) Assignee: AliphCom, San Francisco, CA (US)

( * ) Notice: Subject to any disclaimer, the term of this patent is extended or adjusted under 35 U.S.C. 154(b) by 276 days.

(21) Appl. No.: 12/882,482

(22) Filed: Sep. 15, 2010

(65) Prior Publication Data

US 2011/0222701 A1 Sep. 15, 2011

Related U.S. Application Data

(60) Provisional application No. 61/243,940, filed on Sep. 18, 2009.

(51) Int. Cl.

| | |
|---|---|
| ***H04R 1/10*** | (2006.01) |
| *G10K 11/16* | (2006.01) |
| *H04R 5/033* | (2006.01) |

(52) U.S. Cl.

CPC ..... *H04R 1/1083* (2013.01); *H04R 2201/107* (2013.01); *H04R 1/1041* (2013.01); *H04R 5/033* (2013.01); *H04R 2410/07* (2013.01); *H04R 2420/03* (2013.01); *H04R 2420/07* (2013.01)

USPC ..... 381/74; 381/71.6

(58) Field of Classification Search

USPC ..... 381/74, 11, 71.6, 380, 375

See application file for complete search history.

(56) References Cited

U.S. PATENT DOCUMENTS

| | | | | |
|---|---|---|---|---|
| 6,594,366 | B1 | 7/2003 | Adams | |
| 7,010,332 | B1 | 3/2006 | Irvin et al. | |
| 7,433,484 | B2 | 10/2008 | Asseily et al. | |
| 2002/0076073 | A1 | 6/2002 | Taenzer et al. | |
| 2005/0089186 | A1 | 4/2005 | Kulas | |
| 2007/0116316 | A1 | 5/2007 | Goldberg | |
| 2007/0297634 | A1 | 12/2007 | Hansson | |
| 2008/0089530 | A1 | 4/2008 | Bostick et al. | |
| 2010/0014684 | A1* | 1/2010 | Chen | 381/71.6 |
| 2010/0020998 | A1* | 1/2010 | Brown et al. | 381/380 |

OTHER PUBLICATIONS

International Search Report and Written Opinion mailed Nov. 9, 2011 in Application No. PCT/US2010/049174 filed Sep. 16, 2010.

* cited by examiner

*Primary Examiner* — Vivian Chin
*Assistant Examiner* — Ammar Hamid
(74) *Attorney, Agent, or Firm* — Kokka & Backus, PC

(57) ABSTRACT

An audio system that may be used in multiple modes or use scenarios, while still providing a user with a desirable level of audio quality and comfort. The inventive system may include multiple components or elements, with the components or elements capable of being used in different configurations depending upon the mode of use. The different configurations provide an optimized user audio experience for multiple modes of use without requiring a user to carry multiple devices or sacrifice the audio quality or features desired for a particular situation. The inventive audio system includes a use mode detection element that enables the system to detect the mode of use, and in response, to be automatically configured for optimal performance for a specific use scenario. This may include, for example, the use of one or more audio processing elements that perform signal processing on the audio signals to implement a variety of desired functions (e.g., noise reduction, echo cancellation, etc.).

18 Claims, 9 Drawing Sheets a) In neither ear b) In one ear c) In both ears

Audio Processing Element

MULTI-MODAL AUDIO SYSTEM WITH AUTOMATIC USAGE MODE DETECTION AND CONFIGURATION CAPABILITY

CROSS-REFERENCE TO RELATED APPLICATION

This application claims priority from and the benefit of provisional application No. 61/243,940, filed on Sep. 18, 2009, the full disclosure of which is incorporated herein by reference for all purposes.

BACKGROUND

The present invention is directed to audio systems for use in transmitting and receiving audio signals, and for the recording and playback of audio files, and more specifically, to a portable audio system that is capable of detecting a mode of use and based on that detection, automatically being configured for use in one or more of multiple modes of operation.

Embodiments of the present invention relate to portable systems that perform some combination of the functions of transmitting or receiving audio signals for a user, or recording or playing audio files for a user. Examples of such systems include mobile or cellular telephones, portable music players (such as MP3 players), and wireless and wired headsets and headphones. A user of such a system typically has a range of needs or desired performance criteria for each of the system's functions, and these may vary from device to device, and from use case to use case (i.e., the situation, environment, or circumstances in which the system is being used and the purpose for which it is being used).

For example, when listening to music while on an airplane, a user may desire high-fidelity audio playback from a device that also performs ambient noise reduction of the characteristic noise of the airplane engines. A suitable audio playback device for such situations might be a pair of high-fidelity stereo headphones with adequate passive or active noise cancellation capabilities. As another example, when driving in a car and making a telephone call via a portable telephone, a user may desire good quality noise reduction for their transmitted audio signals, while having a received audio signal that is clearly audible given the ambient noise (and which at the same time does not obscure ambient noise to a degree that causes them to be unaware of emergency vehicles, etc.). A suitable audio playback device for such a situation might be a mono Bluetooth headset with transmitted noise reduction and a suitable adaptive gain control for the received audio signal. As yet another example, when at home and on a lengthy telephone call, a user may desire a device that is very comfortable, and ambient noise reduction may be less of an issue. A suitable device for this use case might be a speakerphone with an acoustic echo cancellation function.

Audio systems are available in many forms that are intended for use in different environments and for different purposes. However, a common feature of such systems is that they are typically optimized for a limited number or types of usage scenarios, where this limited number typically does not include the full range of a user's common audio reception, transmission, recording, and playback requirements. For example, high-fidelity stereo headphones are not an optimal system for a user making a telephone call when driving a car. This is because they do not provide noise cancellation for the transmitted audio, and because they excessively block ambient noise reception to the extent that they may create a driving hazard. Similarly, a mono headset may not be optimal for a lengthy telephone call in a quiet place, because most mono headsets cannot be worn comfortably for extended periods of time.

Because existing personal audio systems that are used for a range of transmission, reception, recording, and playback operations are typically optimized for a limited range of use cases or scenarios, users typically either own and/or carry more than one device, or find that they do not have a suitable or optimal device with them when they require it. For example, it is not uncommon for users to carry both a Bluetooth headset and a pair of stereo headphones; nor is it uncommon for users to own more than one pair of stereo headphones, with each pair being optimized for a different usage situation. However, this arrangement is inconvenient and not desirable for a user; the need to own and/or carry more than one device may cost the user unnecessary money, as many of the components of one system may also be provided in another system. Alternatively, if a user does not have more than one system available, they may lose necessary or desired functionality for a given situation, such as when an owner of a pair of stereo headphones is unable to take a call while driving.

As recognized by the present inventors, there is a need for an audio system that provides some or all of the functions of reception, transmission, recording, and playback, and that provides adequate functionality when used in a wider range of usage situations than presently available systems. Such a system would have the advantage of reducing the cost to a user and improving the convenience and amount of usage a user receives from their audio system.

In this regard, it is noted that there presently exist integrated audio systems that may be used in multiple usage modes; for example, stereo headphones equipped with a microphone that may be used both for listening to music and for making a telephone call. For example, it is possible to use only one earpiece of such stereo headphones, along with the microphone, to make a call while driving. However, such presently available integrated audio systems have significant shortcomings. Typically, usage in a non-primary (i.e., alternative) mode is often uncomfortable for a user, and may not be particularly stable. This may be because the device is not designed to sit comfortably and reliably in place except in the primary position of use.

Another problem with existing integrated or multi-functional audio systems is that the audio quality, particularly with regards to ambient noise reduction on either the transmitted or received audio, is significantly worse than is desired for optimal usage. A cause of this loss of audio quality is that some audio quality features depend on the device being in a particular position; when used in a different position, the device is not in a suitable configuration for these audio quality features to operate in an optimal manner. For example, in the case where a set of stereo headphones provided with a microphone are used on a telephone call while driving with only one earpiece being used, the microphone is typically moved to a new position which is lower down on the body (it no longer being supported by both sides) or moved across to one side of the body. The new position may not be optimal for the microphone to detect the user's speech, and particularly in the case of microphones used for ambient noise reduction on the transmitted audio signal, may be less able to remove ambient noise. This is a because a common technique for removing ambient noise in transmitted audio is to use a shaped detected sound field oriented towards the user's mouth, and the movement of the microphone associated with the system being worn in a different configuration may mean the sound field is no longer optimally oriented.

Another common problem with existing integrated audio systems is that they may waste energy fulfilling incorrect or un-needed functions. For example, if a stereo headset/headphone is only being used in one ear, the energy used to drive the opposite ear's speaker is wasted, as it will not be heard. However, this speaker cannot be turned off permanently because the user might wish to put the earpiece in again at a later time. As another example, audio may be played with less gain through both ears than when played in one ear; this is both because the user is receiving two copies of the audio, and because ambient noise may be lower due to both ears being blocked by earpieces.

What is desired is a multi-modal or multi-functional audio system that enables a user to select a different configuration of the system components depending on the use case or user requirements, without suffering significant deterioration in the audio quality they require, and without loss of comfort or an inefficient use of power. Embodiments of the invention address these problems and other problems individually and collectively, and overcome the noted disadvantages of existing integrated audio systems.

SUMMARY

Embodiments of the present invention are directed to an audio system that may be used in multiple modes or use scenarios, while still providing a user with a desirable level of audio quality and comfort. The inventive system may include multiple components or elements, with the components or elements capable of being used in different configurations depending upon the mode of use. The different configurations provide an optimized user audio experience for multiple modes of use without requiring a user to carry multiple devices or sacrifice the audio quality or features desired for a particular situation. The inventive audio system includes a use mode detection element that enables the system to detect the mode of use, and in response, to be automatically configured for optimal performance for a specific use scenario. This may include, for example, the use of one or more audio processing elements that perform signal processing on the audio signals to implement a variety of desired functions (e.g., noise reduction, echo cancellation, etc.).

In one embodiment, the present invention is directed to an audio system, where the system includes a first earpiece including a speaker, a first configuration detection element configured to generate an output signal representative of whether the first earpiece is being used by a user, a second earpiece including a speaker, a second configuration detection element configured to generate an output signal representative of whether the second earpiece is being used by a user, a system configuration determination element configured to receive the output signal generated by the first configuration detection element and the output signal generated by the second configuration detection element, and in response to generate an output signal representative of the configuration of the audio system being used by the user, and an audio signal processing module configured to process the audio signals from an input source and provide an output to one or both of the first earpiece and the second earpiece, wherein the processing of the audio signals is determined by the configuration of the audio system being used by the user.

In another embodiment, the present invention is directed to a method for operating an audio system, where the method includes determining a configuration of a first element of the audio system, determining a configuration of a second element of the audio system, determining a mode of use of the audio system based on the configuration of the first element and the configuration of the second element, determining a parameter for the processing of an audio signal based on the mode of use of the audio system, receiving an audio signal from an audio input source, processing the received audio signal based on the parameter and providing the processed audio signal as an output to a user.

In yet another embodiment, the present invention is directed to an apparatus for operating an audio system, where the apparatus includes an electronic processor programmed to execute a set of instructions, an electronic data storage element coupled to the processor and including the set of instructions, wherein when executed by the electronic processor, the set of instructions operate the audio system by receiving a signal generated by a first configuration detection element, determining a configuration of a first output device of the audio system based on the signal received from the first configuration detection element, receiving a signal generated by a second configuration detection element, determining a configuration of a second output device of the audio system based on the signal received from the second configuration detection element, determining a mode of use of the audio system based on the configuration of the first output device and the configuration of the second output device, determining a parameter for the processing of an audio signal based on the mode of use of the audio system, receiving an audio signal from an audio input source, processing the received audio signal based on the parameter, and providing the processed audio signal as an output to a user.

Other objects and advantages of the present invention will be apparent to one of ordinary skill in the art upon review of the detailed description of the present invention and the included figures.

DETAILED DESCRIPTION

Figure 1:
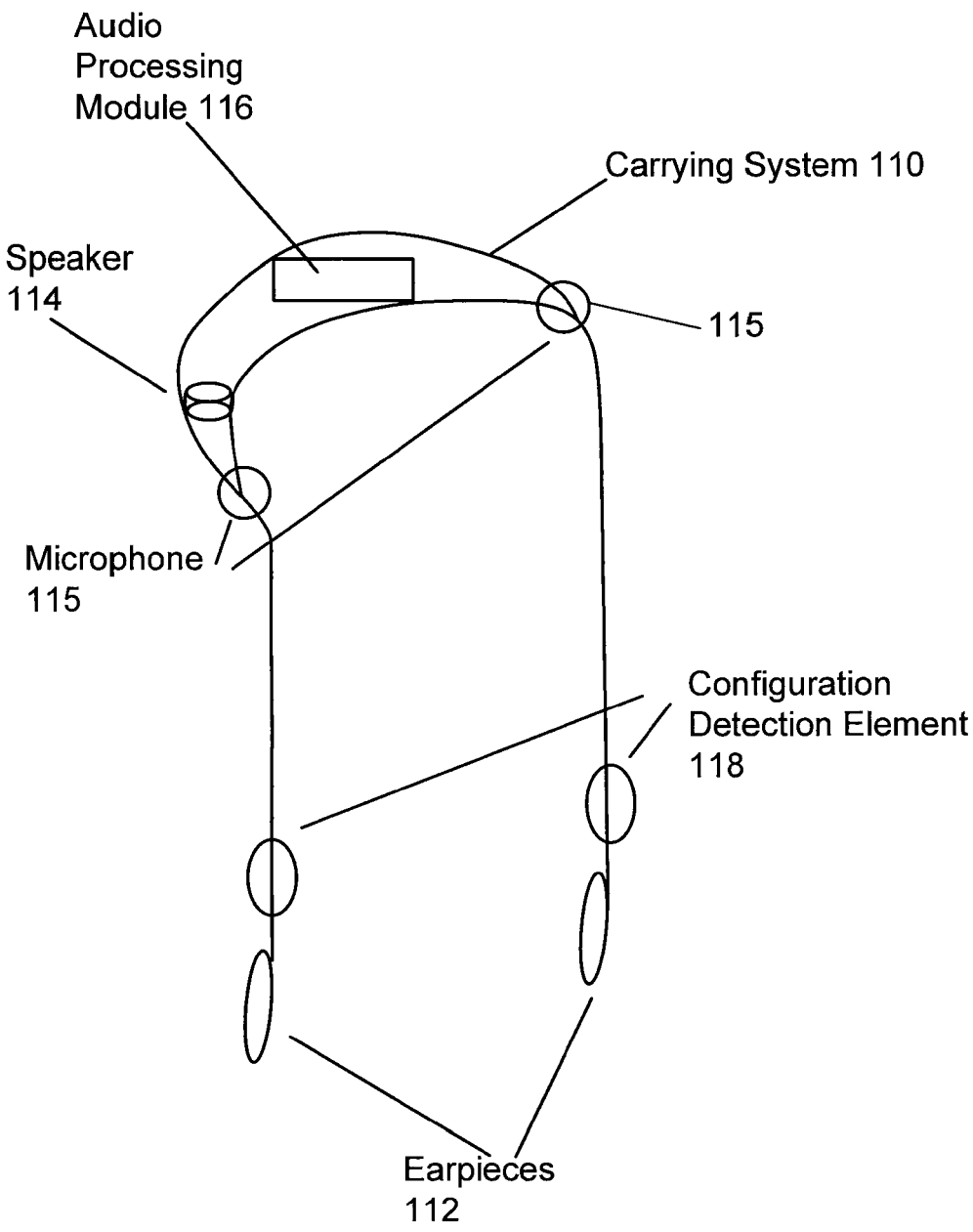
FIG. 1 is a functional block diagram illustrating the primary elements of an embodiment of the inventive multi-modal audio system.

Embodiments of the present invention are directed to an audio system that includes multiple components or elements, with the components or elements capable of being used in different configurations depending upon the mode of use. The different configurations provide an optimized user audio experience for multiple modes of use without requiring a user to carry multiple devices or sacrifice the audio quality or features desired for a particular situation. The inventive audio system includes a mode of use (or configuration) detection element that enables the system to detect the mode of use, and in response, to be automatically configured for optimal performance for a specific use scenario. This may include, for example, the use of one or more audio processing elements that perform signal processing on the audio signals to implement a variety of desired functions (e.g., noise reduction, echo cancellation, etc.).

In some embodiments, the present invention provides an audio reception and/or transmission system that may be used in multiple configurations without significant loss of audio quality. The invention functions to optimize audio reception and/or transmission according to the configuration in which a user is using the audio system. The invention provides an audio reception and/or transmission system that may be used in multiple configurations at a lower overall power level, and a system that may be worn with comfort and functionality under a range of usage conditions.

In some embodiments, the present invention includes one or more of the following elements:

- a set of audio components including speakers and/or microphones;
- a carrying/wearing system designed to allow the audio components to be used in a plurality of configurations, where movement of the audio components within each configuration may be constrained so as to optimize the audio processing functions or operations applied to them;
- a mode of use detector for detecting the configuration currently in use, and/or the position of the system elements; and
- an audio processing element that operates according to the configuration currently in use and/or the position of the elements to optimize the audio quality of the transmitted and/or received audio signals.

In some embodiments, the present invention may therefore function to perform the following operations or processes:

- providing a range of configurations of usage for an audio system;
- detecting the configuration and/or the position of the elements of the audio system; and
- optimizing an audio processing function (recording, playback, transmission, reception) dependent on the configuration in use and/or the position of the elements.

In some embodiments, the inventive audio system may provide the one or more of the following different configurations or modes of use, with audio signal processing optimized for each configuration:

- mono headset capability, whereby the user uses a single earpiece and is able to both receive and/or transmit audio;
- stereo headset capability, whereby the user uses two earpieces, one in each ear, and is able to receive and/or transmit audio; and
- personal speakerphone capability, whereby the user is able to transmit and/or receive audio without use of an earpiece.

In some embodiments, the inventive audio system may include a carrying system for audio components that is designed to enable multiple configurations or modes of use, where the carrying system may include:

- a flexible carrying element that goes around the neck;
- a flexible stiffener element placed within or on the flexible carrying element towards the back of the neck;
- a design having at least 50% of the total weight forward of the Trapezius muscle; and
- two earpieces attached via a flexible mechanism to the flexible carrying element.

An example embodiment of the present invention will be described with reference to the included figures. FIG. 1 is a functional block diagram illustrating the primary elements of an embodiment of the inventive multi-modal audio system.

FIG. 1 illustrates the major components of an example embodiment in which a Carrying System 110 is attached to: (1) two Earpieces 112, each comprising at least one speaker or other audio output element and optionally, one or more microphones (not shown); (2) a Speaker 114, and optionally one or more additional Microphones 115; (3) an Audio Processing Module 116; and (4) one or more Configuration or Mode of Use Detection Elements 118. Note that in the example embodiment, a Mode of Use Detection Element 118 is provided for each Earpiece 112. Note further, that in this example, Earpieces 112 are attached to Carrying System 110 by a flexible means such as a cable, and may move in relation to the Carrying System. Both rigid and flexible means made of different materials may be used, provided that the user is able to move Earpieces 112 into and out of their ear as desired for comfort and usage.

The inventive system may be used in conjunction with a device or apparatus that is capable of playing audio files or operating to process audio signals, where such a device or apparatus is not shown in the figure. For example, the invention might be used with a mobile telephone, with audio signals being transmitted to, and received from the telephone by means of a wireless transmission system such as a Bluetooth wireless networking system. Alternatively, the invention may be used with a portable audio player (such as a MP3 player), with the audio signals being exchanged with the inventive audio system by means of a wired or wireless connection. Other devices or systems that are suitable for use with the present invention are also known, as are means of connecting to such systems, both wirelessly and through a wired mechanism or communications network.

Carrying System 110 illustrated in FIG. 1 is intended to be worn around the neck, and may take any one of many suitable forms (an example of which is described below). Carrying System 110 is designed to ensure that the component audio elements remain in suitable operating positions and to allow the elements to be correctly connected together for optimal use of the inventive system for each of its multiple modes of usage. In addition to the embodiment depicted in FIG. 1, other suitable implementations of Carrying System 110 are possible, including those that are worn around the neck, over the head, around the head, or clipped to clothing, etc. Carrying System 110 may be made of any suitable materials or combination of materials, including plastic, rubber, fabric or metal, for example. Earpieces 112 are attached to Carrying System 110 and function to transport signals between Audio Processing Module 116 and the user's ear or ears. The signals may be any suitable form of signals, including but not limited to, analogue electronic signals, digital electronic signals, or optical signals, with earpieces 112 including a mechanical, electrical, or electro-optical element as needed to convert the received signals into a form in which the user may hear or otherwise interact with the signals.

Earpieces 112 are designed to rest on and/or in the ear when in use, and to carry audio signals efficiently into the ear by means of a speaker (or other suitable audio output element) contained within them. Earpieces 112 may also be designed to limit the ambient noise that reaches the ear, such as audio signals other than those produced by the speaker contained in the earpiece. Such earpieces may be designed to fit within the ear canal together with rubber or foam cushions capable of sealing the ear canal from outside audio signals. Such earpieces may also be designed to sit within the outer ear, with suitable cushioning designed to ensure comfort and to limit the amount of ambient noise reaching the inner ear. Further, such earpieces may be designed to sit around the ear, positioned on an outer portion of the ear.

Earpieces 112 may optionally include one or more microphones, and if included, these microphones may be arranged so as to optimally detect the user's speech signals and to reject ambient noise. A suitable device or method for the detection of a user's speech signals and the rejection of ambient noise is described in U.S. Pat. No. 7,433,484, entitled "Acoustic Vibration Sensor", issued Oct. 7, 2008, the contents of which is hereby incorporated by reference in its entirety for all purposes. Earpieces 112 may contain a Configuration or Mode of Use Detection Element 118, the structure and function of which will be described. For example, an earpiece might contain an accelerometer that functions as Detection Element 118, or a microphone used as a Detection Element (such a microphone being provided in addition to those used to detect speech, or being the same microphone(s) but capable of operating for such a purpose).

As will be described, Detection Element 118 operates or functions to provide signals or data which may be used determine the configuration in which the user is using the audio system. For example, a detection element may be used to determine which of the earpieces are in use in the ear, and which are not in use in the ear. Audio Processing Module 116 may include a Configuration Determining Element and an Audio Processing Element, and may include other components or elements used for the processing or delivery of audio signals to a user.

The Configuration Determining Element operates or functions to determine (based at least in part on the information provided by Detection Element 118) the overall configuration or mode of use of the audio system. This information (along with any other relevant data or configuration information) is provided to the Audio Processing Element so that the processing of the audio signals being received or generated by elements of the system (or provided as inputs to the system) may be optimized based on the configuration of the elements being used by the user.

The Audio Processing Element operates or functions to perform signal processing on the transmitted, received, recorded, or played back audio signals or files. For example, the Audio Processing Element may perform ambient noise removal on the transmitted signal in a manner described in the previously mentioned United States patent entitled "Acoustic Vibration Sensor". The Audio Processing Element may perform ambient noise cancellation on the received signal, for example by creating an anti-signal to ambient noise signals, in a manner known to those skilled in the art. The Audio Processing Element may perform an equalization or adaptive equalization operation on the audio signals to optimize the fidelity of the received audio. For example, when the inventive audio system is being used in a stereo mode of operation, the equalization may be optimized to best convey to a user those types of signals that can be most clearly heard in stereo (for example, by providing a bass boost). When used in a mono configuration, the equalization operation may be optimized to best convey to a user those signals that are most commonly used in a mono mode of operation (for example, by boosting frequencies common in speech, so as to improve intelligibility).

Figure 2:
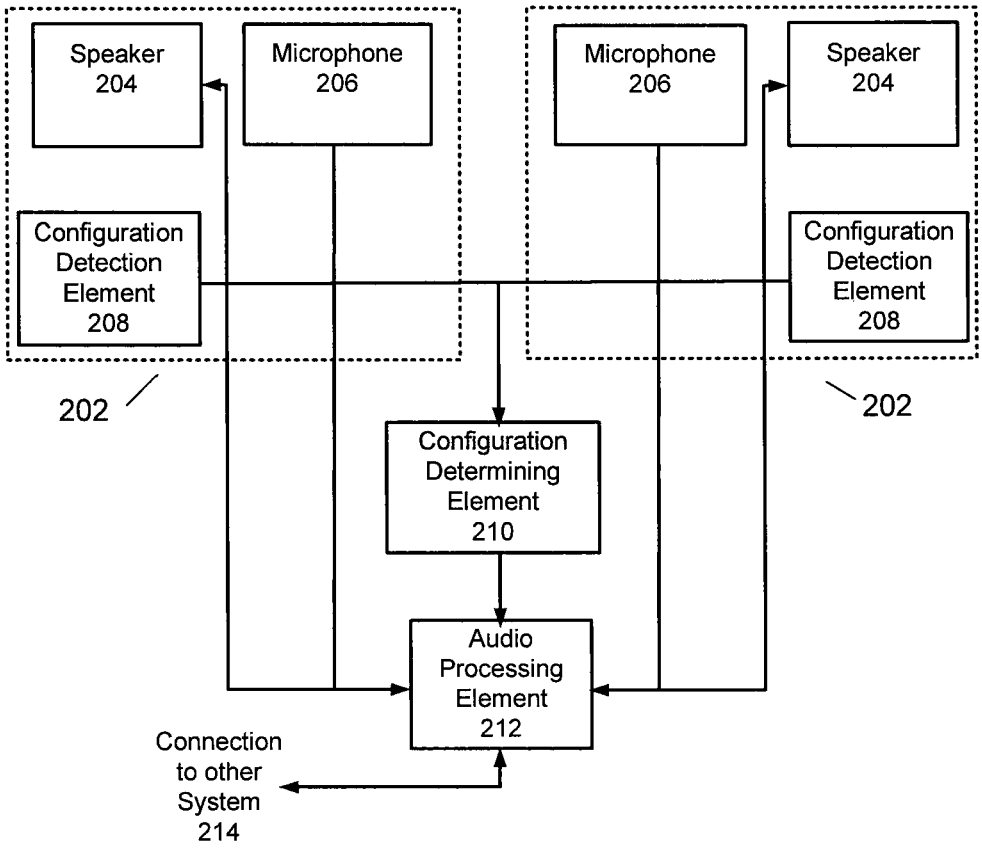
FIG. 2 is a block diagram illustrating the primary functional elements of an embodiment of the multi-modal audio system of the present invention, and the interoperation of those elements.

FIG. 2 is a block diagram illustrating the primary functional elements of an embodiment of the multi-modal audio system 200 of the present invention, and the interoperation of those elements. FIG. 2 illustrates two Earpieces 202, each comprising a speaker 204 and one or more microphones 206, and each either provided with, or containing a Configuration Detection Element 208. Note that although Configuration Detection Element 208 is depicted as part of Earpiece 202 in FIG. 2, this arrangement is not necessary for operation and function of the invention. Depending upon the embodiment of the invention, Configuration Detection Element 208 may be part of or may be separate from Earpiece 202 (as is depicted in FIG. 1). The Configuration Detection Element(s) 208 are electrically or otherwise connected/coupled to a Configuration Determining Element 210. Audio Processing Element 212 is electrically or otherwise connected/coupled to the speakers 204 and microphones 206 of Earpieces 202, and to the output of Configuration Determining Element 210.

Configuration Detection Element(s) 208 operate or function to determine whether the Earpiece 202 to which they are attached or otherwise coupled is currently in use by the user. Configuration Detection Element(s) 208 may be of any suitable type or form that is capable of functioning for the intended purpose of the invention. Such types or forms include, but are not limited to, accelerometers, microphones, sensors, switches, contacts, etc. The output of Configuration Detection Element(s) 208 may be a binary signal, an analogue waveform, a digital waveform, or another suitable signal or value that indicates whether or not the given earpiece is currently in use. Note that in some embodiments, the output of Configuration Detection Element(s) 208 may also indicate the orientation or provide another indication of the position or arrangement of the earpiece.

Configuration Determining Element 210 receives as input (s) the signals from the Configuration Detection Element(s) and operates or functions to determine in which configuration or mode of use the inventive system is being used by the user. The output of Configuration Determining Element 210 is an analogue, digital, binary, flag value, code, or other form of signal or data that indicates the overall system configuration being used. This signal or data is provided to Audio Processing Element 212. Configuration Determining Element 210 may be implemented in the form of an analog or digital circuit, as firmware, as software instructions executing on a programmed processor, or by other means suitable for the purposes of the invention.

As will be described, Audio Processing Element 212 operates or functions to produce audio output to one or more speakers (depending on the configuration in use), to receive audio from one or more microphones (depending on the configuration in use), and to process other input audio signals to provide output signals in a form or character that is optimized for the configuration or mode of use in which the audio system is being used. Audio Processing Element 212 may be implemented in the form of a digital signal processing integrated circuit, a programmed microprocessor executing a set of software instructions, a collection of analog electronic circuit elements, or another suitable form (for example, the Kalimba digital signal processing system provided by CSR, or the DSP560 provided by Freescale Semiconductor). Audio Processing Element 212 is typically connected to another system 214 that acts as a source or sink for audio signals. For example, Audio Processing Element 212 might be connected to a Bluetooth wireless networking system that exchanges audio signals with a connected mobile telephone. In another embodiment, Audio Processing Element 212 may be connected to a MP3 player or other source of signals.

Figure 3:
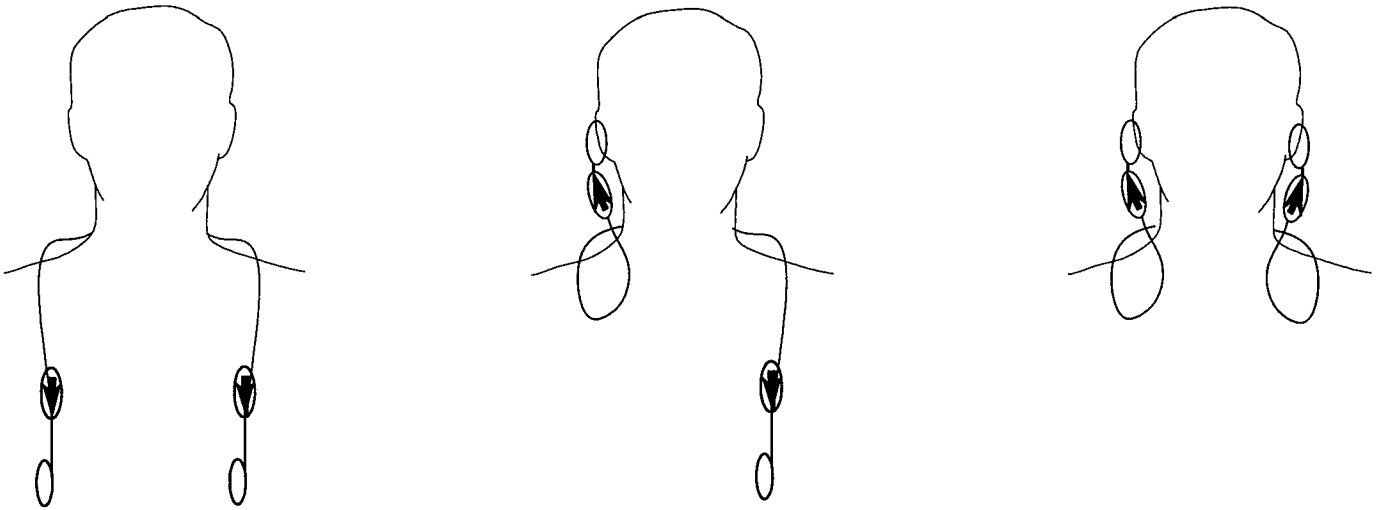
FIG. 3 is a diagram illustrating a set of typical usage scenarios for the inventive system, and particularly examples of the placement of the Earpieces and the arrangement of the Configuration Detection Element(s) for each Earpiece.

FIG. 3 is a diagram illustrating a set of typical usage scenarios for the inventive system, and particularly examples of the placement of the Earpieces and the arrangement of the Configuration Detection Element(s) for each Earpiece. In the first example in FIG. 3 (*a*), neither Earpiece is in use, and as shown, the Configuration Detection Element(s) are oriented so that the end nearest the Earpiece is the lower end, as marked by the downward pointing arrows. In the second example in FIG. 3 (*b*), one Earpiece is in use, and it will be seen that the Configuration Detection Element of that Earpiece is oriented so that the end nearest the Earpiece is the upper end (as indicated by the upward pointing arrow), and in the other (the Earpiece not being used) it is the lower end. In the third example in FIG. 3 (*c*), both Earpieces are in use, and the Configuration Detection Elements of both are oriented such that the end nearest the Earpiece is the upper end.

Note that when an Earpiece is not in position in the user's ear, the user does not expect to use that Earpiece, and the speaker and microphones for that Earpiece need not be active. Therefore the first example in FIG. 3 (*a*) illustrates a configuration in which the user intends to use the Speaker and any Microphones contained in the body of the inventive multi-modal audio system and not those in the Earpieces. The second example in FIG. 3(*b*) illustrates a configuration in which the user wishes to use only one Earpiece, and thus only the Speakers and Microphones in that Earpiece need be active. The third example in FIG. 3(*c*) illustrates a configuration in which the user wishes to use both Earpieces and thus both Earpieces need to have active speakers and microphones.

Figure 4:
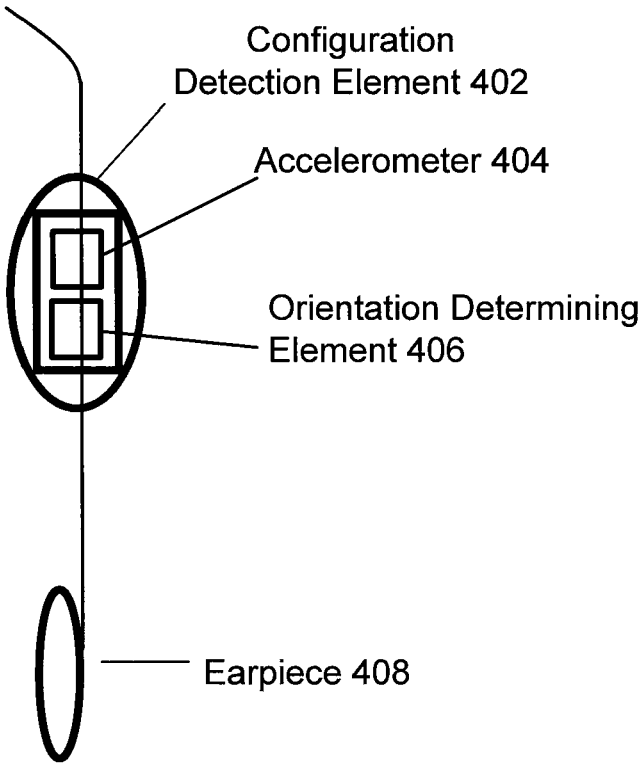
FIG. 4 is a functional block diagram illustrating an exemplary Configuration Detection Element (such as that depicted as element 118 of FIG. 1 or element 208 of FIG. 2) that may be used in an embodiment of the present invention.

FIG. 4 is a functional block diagram illustrating an exemplary Configuration Detection Element 402 (such as that depicted as element 118 of FIG. 1 or element 208 of FIG. 2) that may be used in an embodiment of the present invention. In some implementations, Configuration Detection Element 402 may be implemented in the form of a printed circuit board or other substrate on which is provided an accelerometer 404 and an orientation determining element 406, where accelerometer 404 is attached to the Earpiece 408 in such a manner that its orientation is in one direction when the Earpiece is not in use, and in an opposite direction when the Earpiece is in use. Accelerometer 404 may be implemented, for example, in the form of a silicon MEMS accelerometer (such as manufactured by Bosch or another suitable provider). Orientation determining element 406 may be provided as part of the silicon MEMS accelerometer, or may be provided by a switch or other indicator, software code executed by a programmed microprocessor (for example a MSP430 microprocessor or another suitable microprocessor), or another suitable element.

In operation, when Earpiece 408 is not in use and is hanging down, the force of gravity acts in one particular direction across the accelerometer, a direction for the sake of example that can be designated as the positive X axis. Thus the acceleration measured by accelerometer 404 when Earpiece is not in use is approximately +9.8 m/s/s in the X direction (the acceleration due to gravity). When Earpiece 408 is in use, that is in the ear, the force of gravity is acting in an opposite direction across the accelerometer, by virtue of the fact that Earpiece 408 has been rotated as it is placed into the ear. Thus in this configuration accelerometer 404 will measure a force of approximately −9.8 m/s/s in the X direction when in use, depending on the exact orientation of Earpiece 408, the means by which it is connected to a carrying system, and the placement of Configuration Detection Element 402.

Thus in this example implementation, the orientation of Configuration Detection Element 402 (and hence the Earpiece 408, and by inference the usage state or mode of the Earpiece and of the audio system) may be determined by Orientation Determining Element 406 operating to process the output of accelerometer 404. For example, in the situation described, Orientation Determining Element 406 may perform the following processing:

If accelerometer X-axis reading>0, the earpiece is NOT IN USE

If accelerometer X-axis reading<=0, the earpiece is IN USE where such a function or operation may be implemented by software code executing on a suitably programmed microprocessor or similar data processing element.

Such software code or a set of executable instructions, executing for example on a programmed microcontroller or microprocessor, may periodically (for example once every millisecond) read the accelerometer value, and determine the acceleration parallel to the Earpiece wire (or relative to any other suitable direction). The code then determines the orientation of the Earpiece and hence the Earpiece configuration and the mode of use of the Earpiece. The code may compare the current Earpiece configuration or mode of use to the configuration or mode of use derived from the previous accelerometer reading. If the Earpiece configuration or mode of use has not changed, the software code may cause a suitable delay (such as 1 second) before performing the function again.

If the Earpiece configuration or mode of use has changed, then the inventive system will need to determine the overall Audio System Configuration, from the configurations or modes of use of the set of elements of the system (as determined, for example, from one or more orientation or configuration detection elements). This may, for example, be performed by looking up the configuration in a table that relates the configurations or modes of use of one or more of the individual elements to the overall Audio System Configuration (as will be described with reference to the following Table). If the Audio System Configuration or mode of use has changed, then new system configuration parameters may be determined, for example by looking them up in a table relating the System Configuration Mode to the configuration or operating parameters for the various system elements. These configuration settings or operating parameters may then be implemented (as applicable) by Audio Processing Element 212 of FIG. 2 for each element of the overall Audio System.

Figure 5:
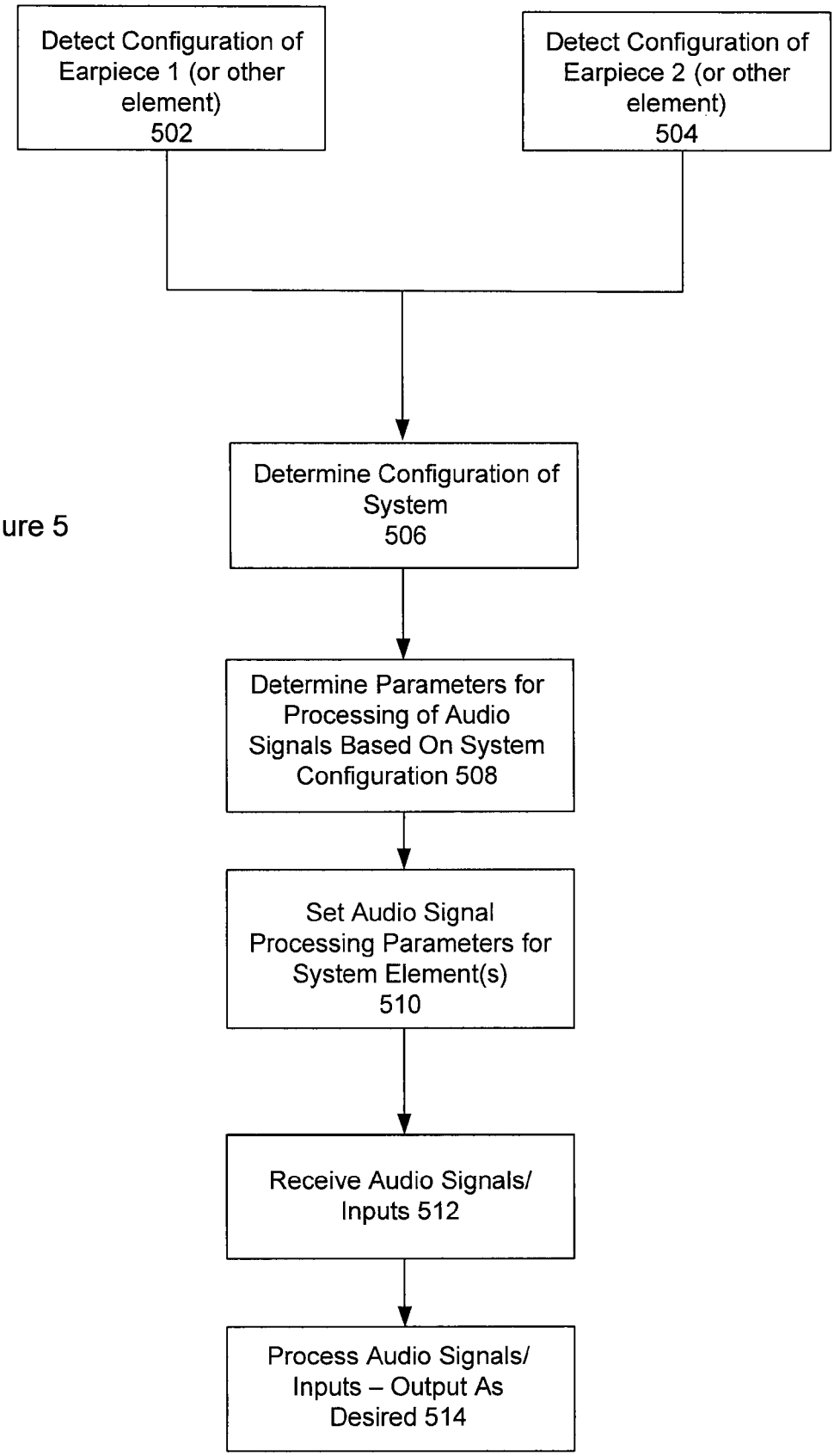
FIG. 5 is a flowchart illustrating a method or process for configuring one or more elements of a multi-modal audio system, in accordance with an embodiment of the present invention.

FIG. 5 is a flowchart illustrating a method or process for configuring one or more elements of a multi-modal audio system, in accordance with an embodiment of the present invention. As shown in the figure, the configuration of a first Earpiece (identified as "Earpiece 1" in the figure) is detected at stage 502. The configuration of a second Earpiece (identified as "Earpiece 2" in the figure) is detected at stage 504. Note that although stages 502 and 504 refer to detecting the configuration of an Earpiece, the use of an Earpiece is for purposes of example as some audio systems may utilize one or more of an earpiece, a headset, a speaker, etc. Further, although a first and second Earpiece are used in the example depicted in FIG. 5, other embodiments of the present invention may utilize either fewer or a greater number of elements for which a configuration is detected.

Note also that although the process or operation occurring at stages 502 and 504 is described using the terms "detect configuration", these are general terms meant to refer to and include processes, operations, or functions such as determining or sensing a mode of use or orientation, detecting or sensing a mode of use or orientation, etc. In general, stages 502 and 504 are meant to include use of any suitable elements and any suitable processes, operations, or functions that enable the inventive system to determine information about the system elements that can be used to determine or infer the configuration (or use case, mode of use, etc.) of the overall audio system. The processes, operations, or functions implemented will depend upon the structure and operation of the element or sensor used to provide data about the mode of use, orientation, or other aspect of a system element. Thus, depending upon the element or sensor being used, the type of data or signal generated by that element or sensor may differ (e.g., electrical, acoustic, pulse, binary value, etc.), and the determined or inferred information about the mode of use, orientation, or configuration of the system element may likewise be different (e.g., position relative to a direction, placed or not in a specified location, enabled or disabled, etc.).

In some embodiments, a sensor (such as an accelerometer), switch, or other element may be used in Earpiece 1 and in Earpiece 2 to generate an output that represents its state, mode of use, orientation, configuration, etc. The information generated by this Configuration Detection Element (such as element 206 of FIG. 2 or element 402 of FIG. 4) is provided to a System Configuration Determining Element (such as element 210 of FIG. 2) at stage 506. The information (which may be represented as a signal, value, data, pulse, binary value, etc.) is used to determine the configuration or mode of use of the system (e.g., mono, stereo, speakerphone, etc.). This may be determined by comparing the configuration data for the Earpieces (e.g., "in use", "not in use") to a table, database, etc. that uses the configuration data as an input and produces information or data representing the system configuration or mode of use as an output. The system configuration or mode of use may be represented as a code, indicator value, or other form of data. The data representing the system configuration is provided to an element (such as element 212 of FIG. 2) that uses that data to determine the audio signal processing parameters for one or more of the elements of the inventive system (stage 508). This may involve setting one or more operating characteristics or operational parameters (e.g., gain, echo cancellation, equalization, balance, wind compensation, volume, etc.) for each of one or more system elements (e.g., speakers, microphones, etc.). The operational characteristics or parameters are then set for the relevant system element or elements (stage 510). The inventive audio system is now properly configured to operate in a desired manner (typically an optimal manner) for the current mode of use of the system elements.

The inventive system then receives an audio signal or signals, or other form of input (stage 512). Such a signal or input may be provided by a microphone that is part of an earpiece, by a microphone that is separate from an earpiece (such as one that is associated with a wireless phone), by an MP3 or other form of music player, by a portable computing device capable of playing an audio file, etc. The received audio signal or other form of input is processed in accordance with the operational characteristics or parameters that are relevant for each of the applicable system elements for the system configuration, and provided as an output to the appropriate system element (stage 514). Thus, for example, because the audio system is being used in a speakerphone mode of use, the received or input signal might be processed in a manner that is desired or optimal for the speakerphone mode.

Note that there are many suitable types of Configuration Detection Elements (illustrated as element 208 of FIG. 2 or element 402 of FIG. 4) that may be used in embodiments of the present invention. For example, a microphone may be used within the Earpiece, with the output of the microphone being monitored to detect speech (and hence to infer that the Earpiece is in use). Alternatively, when the Earpiece is not in use, it may be docked or inserted into another element of the system, where the docking mechanism may be supplied with an element to detect or sense whether the Earpiece is "docked", such as a push-button switch that is depressed when the Earpiece is docked, a magnetic detection system such as a Hall Effect Sensor, or another suitable sensor or detection mechanism. As yet another example, each Earpiece may contain or be associated with a mercury switch or other type of switching element in which a circuit is opened or closed depending upon the orientation of the switch (and hence of the Earpiece).

Figure 6:
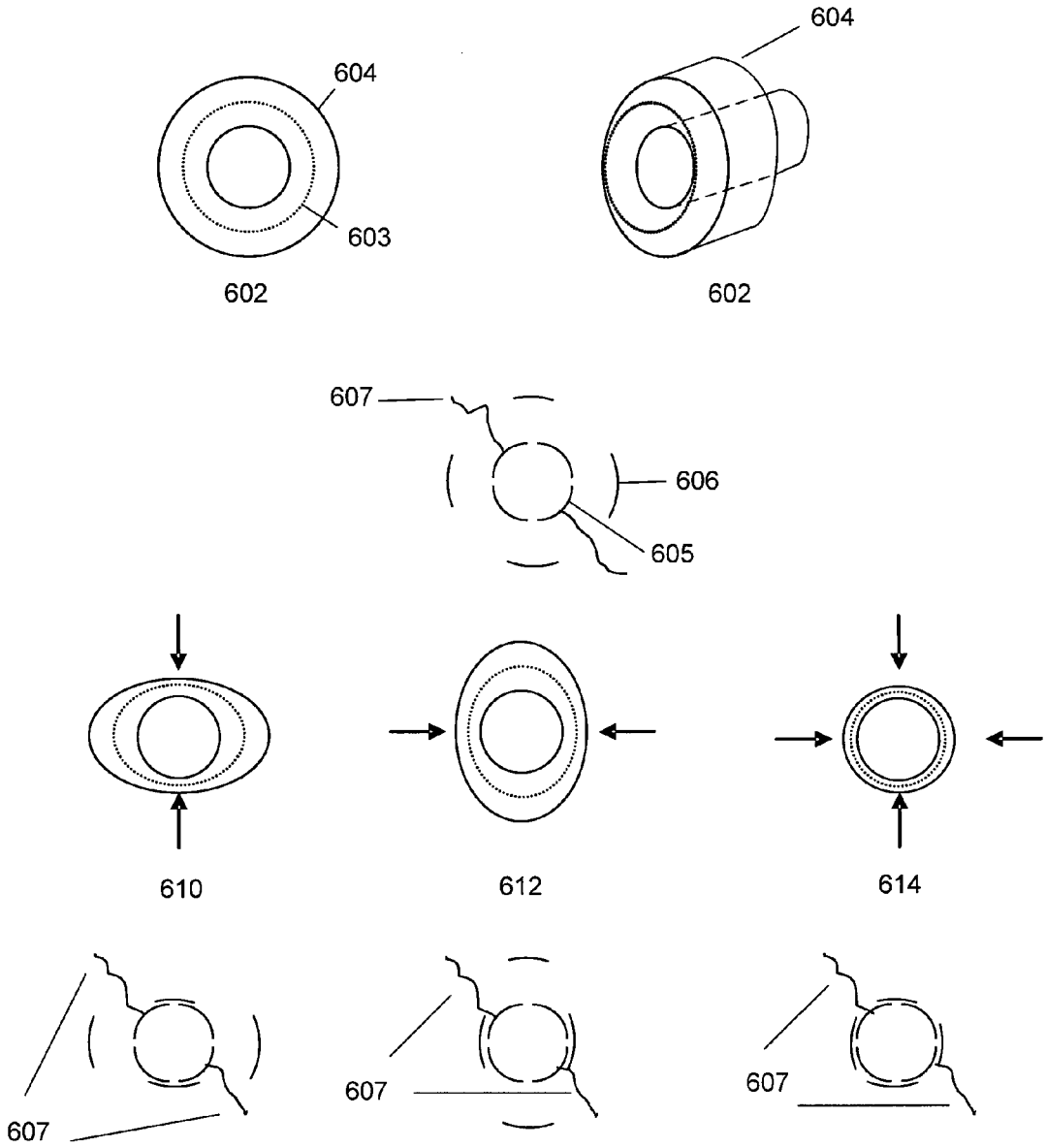
FIG. 6 illustrates two views of an example rubber or silicone earbud, and illustrates how a distortion of the earbud during use may function as a configuration detection element, for use with the inventive multi-modal audio system.

As an example of another suitable Configuration Detection Element, a rubber or silicon earbud used to assist with retaining the earpiece in the ear may be modified to allow detection of when the earpiece is in use, as illustrated in FIG. 6. FIG. 6 illustrates two views of an example rubber or silicone earbud, and illustrates how a distortion of the earbud during use may function as a configuration detection element, for use with the inventive multi-modal audio system. As shown in the figure, an earbud 602 used to position and retain an earpiece in a user's ear may fit over an earpiece and include an inner 603 and outer region 604.

As will be described, earbud 602 is provided with conductive contacts which may be used to assist in determining when the earbud or earpiece is in use. In one embodiment, earbud 602 includes an inner set of conductive conducts 605 formed on (or applied to) the outer side of the inner region 603 of the earbud, and an outer set of conductive contacts 606 formed on (or applied to) the inner side of the outer region 604 of the earbud. Conductive contacts 605 and 606 are arranged so that it is possible for the contacts to make electrical contact when the earbud is compressed as a result of the earpiece and earbud having been inserted into a user's ear. Also shown in the figure are two example wires 607 connected to opposite quadrants of the inner conductive contacts.

The figure also illustrates three example compressions of the earbud: from top and bottom 610, from left and right 612, and from all sides 614. The resulting arrangement of the conductive contacts in these example compressions are shown below the illustrated compression. Note that compression of an earbud from one side or along one axis or direction (as illustrated in example compressions 610 and 612) is typically not indicative of the earbud being in use; for example, the user might be holding the earbud in order to raise it or lower it, or it might be in a pocket and pressed against the side of the pocket. Note also that compression from all sides (as illustrated in example compression 614) typically occurs when the earbud is placed in the ear, but rarely otherwise.

Due to the arrangement of the contacts, an electrical connection is formed between the two wires 607 when the earbud is compressed in all directions (example 614) and not when it is compressed in one direction (examples 610 and 612). Thus in this implementation, the earbud and contacts act as a switch which is closed when the earbud is in the ear (and therefore in use), and remains open when not in use.

Conductive contacts 605 and 606 may be formed by any suitable method or process; including for example, by use of a conductive ink printed appropriately on the earbud, by appropriate use of a conductive rubber or silicone, by forming the earbud around a set of metal contacts, or by dipping the earbuds into a conductive liquid together with removing or masking the appropriate areas.

Yet another suitable Configuration Detection Element may be formed by measuring the changes in capacitance of a suitable conductive surface which is appropriately coupled to the ear when the earpiece is in a user's ear. This implementation may be used because the capacitance of a conductive surface changes when in close proximity with the human body, and placement of the earpiece/earbud inside the ear brings the surface into close proximity with the human body over a substantial region.

Another Configuration Detection Element may be formed by use of a material whose resistivity is a function of (e.g., dependent on) its Poisson ratio, or equivalently the compression of the material. This implementation is based on the observation that an earbud in the ear is compressed to a greater degree, and more evenly, than one not in the ear (at least under most circumstances). If the earbud is made of a material whose resistivity is dependent on compression (such as a graphite-loaded rubber or foam), then the resistance of the earbud between any pair of suitably chosen points on the earbud will also be a function of the amount or degree of compression. As a result, measuring the resistance between sets of points allows detection of whether the earbud is in use or not.

Note that such a Configuration Detection Element (i.e., one based on a change in electrical properties as a function of the compression or orientation of a material) provides a range of possible outputs, depending on how tightly the earbud is pressed into the ear, and may be used to detect different modes of use such as "not in use", "loosely in use" and "tightly in use". Inferences may be drawn from the degree of use as to what the usage context or configuration is for the individual elements and the audio system.

The following table illustrates an exemplary output of the Configuration Determining Element 210 of FIG. 2 for different combinations of outputs from the Configuration Detection Element(s) 208 of the inventive multi-modal audio system. In each case Configuration Determining Element 210 generates an output signal, data stream, code, etc. that represents the appropriate System Configuration:

| Left Earpiece Detection Element | Right Earpiece Detection Element | System Configuration |
|---|---|---|
| NOT IN USE | NOT IN USE | Speakerphone |
| IN USE | NOT IN USE | Left mono headset |
| NOT IN USE | IN USE | Right mono headset |
| IN USE | IN USE | Stereo headset |

Figure 7:
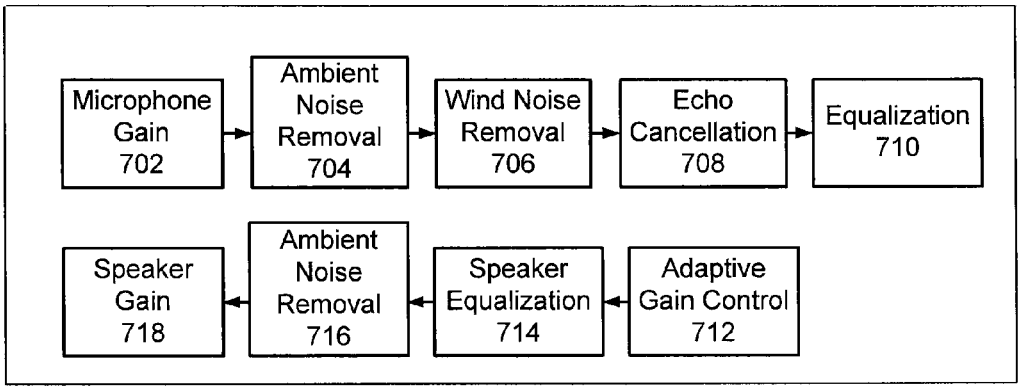
FIG. 7 is a functional block diagram illustrating the components of the Audio Processing Element of some embodiments of the present invention.

As described, based on the system configuration, input or output audio signals may be subjected to appropriate processing operations. In some embodiments, Audio Processing Element 212 of FIG. 2 may be implemented in a manner to subject inbound and/or outbound audio signals to a range of signal processing functions or operations. Such signal processing functions or operations may be used to improve the clarity of signals, remove noise sources from signals, equalize signals to improve the ability of a user to discriminate certain frequencies or frequency ranges, etc. In this regard, FIG. 7 is a functional block diagram illustrating the components of the Audio Processing Element (such as element 212 of FIG. 2) of some embodiments of the present invention. The figure illustrates example effects or signal processing operations that may be applied to the audio signal transmitted from different microphones and/or the audio signal output to different speakers in an exemplary implementation of the inventive system. These effects or signal processing operations include, but are not limited to:

For the microphone(s)
- adjusting the microphone gain 702 (or compensating for a lower than desired gain);
- removal of ambient noise from the microphone signal 704;
- removal of noise produced by wind from the microphone signal 706;
- echo cancellation 708; or
- equalization operations 710;

For the speaker(s)
- adaptive gain control 712;
- speaker equalization 714;
- removal of ambient noise 716; or
- adjustment of speaker gain 718.

The following Table illustrates example settings for certain of the effects or signal processing operations for the configuration or mode of use indicated (i.e., Speakerphone, Left Mono, etc.). Note that depending upon the mode of use and the user's preferences, the values shown may differ from what is implemented for the elements of the inventive audio system:

| | Setting | | | |
|---|---|---|---|---|
| Element | Speaker-phone | Left Mono | Right Mono | Stereo |
| Microphones in Use | Body | Left | Right | Left or Right |
| Speakers in Use | Body | Left | Right | Both |
| Microphone Gain | 20 dB | 10 dB | 10 dB | 10 dB |
| Microphone Ambient Noise Removal | Large separation | Small separation | Small separation | Small separation |
| Wind Noise Removal | Off | On | On | Choose best |
| Echo Cancellation | On | Off | Off | Off |
| Microphone Equalisation | For Speech | For Speech | For Speech | None |
| Adaptive Gain Control | Off | On | On | Off |
| Speaker Equalisation | Extra Bass | For Speech | For Speech | For Music |
| Speaker Ambient Noise Removal | Off | Off | Off | On |
| Speaker Gain | 20 dB | 10 dB | 10 dB | 6 dB |

Thus, in different modes of use or usage configurations, different speakers and microphones are used by the system; therefore, audio signals being generated or being received by those speakers and microphones may be subject to processing by the Audio Processing Element. Further, the component functions or operations implemented by the Audio Processing Element (such as gain, wind noise removal, equalization, etc.) may have different settings or operating parameters in different modes of use.

As an example, consider the use case in which a user is using the inventive system in the speakerphone mode. In this situation, they will not be using either of the Earpiece speakers and if present, the corresponding microphones (where, as noted, the microphones may also function as configuration detection elements). The primary microphone for the speakerphone configuration is likely to be further away from the user's mouth and so require a larger gain to provide a desired level of performance. The separation of the microphone(s) on the body of the device might be larger than the separation when using the Earpieces, so a large separation parameter might be used for ambient noise removal. It might be assumed that a user wouldn't use the system in this configuration in a very windy environment, so the wind noise removal processing might be turned off. Echo cancellation processing would presumably be desired as speakerphones are particularly prone to this problem. Given that the speaker is larger than those in the Earpieces, an increased bass component might be provided by the equalization function to take advantage of this situation. And, given that the speaker is further from the ear, additional speaker gain might be provided to improve fidelity.

Next, consider the example use case in which one earpiece is being used. The corresponding speaker and microphone(s) would be used. Wind noise removal processing might be turned on, as the user may be more likely to use this mode when in a windy environment, and the ambient noise removal might be tuned for the separation of the microphones in the Earpiece.

As another example, consider the use case where both Earpieces are being used. Because audio is heard in both ears, and because ambient noise will be blocked (either partially or fully) in both ears, the volume may be lower and still produce the same apparent sound level as perceived by the user. The wind noise removal processing may now attempt to pick which microphone has the least wind noise, it being assumed that one Earpiece may be better shielded from the wind by the user's head than is the other Earpiece. It might be assumed that the user is more likely to be listening to music in stereo than in mono mode, so the equalization settings might be altered to improve the response of the Earpieces to music.

Based on the detected mode of use, a range of the operating parameters of the system may be altered to achieve a variety of use-specific benefits. Examples of these operating parameters and mode of use specific benefits will now be discussed. As a first example, echo cancellation is commonly desired when duplex audio transmission is occurring (for example, when the user is on a phone call). Echo cancellation can consume significant amounts of power, particularly when advanced echo cancellation techniques are used. The filter length, a critical parameter of many echo cancellation systems, varies according to the distance between the echo source (for example the local loudspeaker) and the microphones that pick up the echo. Therefore, certain parameters of the echo cancellation system are mode of use or configuration dependent. For example, when the user is only listening to music, no echo cancellation is required, and thus the echo cancellation may be switched off to save power. When the user is talking via an earpiece (and the speaker in the earpiece is in use), a shorter filter length may be used, and a less complex technique may be applied. Also, because the distance between the microphones and speakers is fixed in this case, a non-adaptive echo cancellation technique may be used. In the case where the user is listening to audio via a loudspeaker, and the earphones are not in the ear, the distance between the microphone and speaker may be larger, so a longer filter length may be used, and an adaptive processing technique may also be used.

Another parameter that may be changed to obtain benefits in the performance of the audio system is the gain of certain components of the system. When a user is using one earpiece, their other ear is open to noise coming from the surrounding environment. However, when they are using both earpieces, both ears may benefit from the reduction in noise achieved by use of the earpieces (for instance due to blocking of the ear canal to noise from the environment) and as a result, the volume of received audio may not need to be set as high in order to achieve the same apparent level of volume. Therefore a different gain setting may be used in these different modes of use.

When only one earpiece is in use, it is substantially harder for a user to detect apparent differences in the spatial position of an audio source (i.e., the stereo spatialization effect) than when both earpieces are in use (in which case traditional stereo balance techniques may be used). In the case where only one earpiece is in use, extra processing to create a stereo spatialized stream may be turned off to save power or processing capability, or additional processing may be added (such as the combining of stereo streams into a mono stream) to provide an optimal user audio experience.

Further, when a user is using one earpiece, the audio quality they are able to detect may be lower than when using two earpieces. This may be because of the substantial difference in the audio being received by the user's ears, and also because of quality differences associated with audio systems (such as telephony) that are typically used in a mono mode (and which offer a lower quality than typical stereo systems). In such a circumstance, not only may the second earpiece's audio stream be muted, but the bandwidth and sample rate of the first earpiece (i.e., the active earpiece) may be reduced without a noticeable loss of quality. By doing so, the processing power and power consumption used in performing audio signal processing may be reduced. For similar reasons, it may be appropriate to use different settings for an equalization filter; for example, to boost the frequencies most likely to be important in mono mode (and hence, for example, make received speech more intelligible), or to boost frequencies more likely to be missed (and hence make music reproduction closer to the original source or to an optimal level).

A feature of some audio systems is a need for a fixed or constrained physical relationship between certain of the component elements. An example is with noise cancellation systems used with multiple microphones. An important element in such systems is the distance between the microphones, and the distance from and direction towards the mouth. If the microphones turn away from the mouth, or if the relative distance to the mouth from each microphone does not remain approximately constant, then the noise cancellation performance may be degraded, lost entirely, or be the source of undesirable noise artifacts.

In some portable audio systems, it can be difficult to keep the audio elements within desired constraints, particularly when the user changes the mode of use. For example, in the case of a wired stereo headphone with a microphone on the wire, when the user takes one earpiece out of their ear, the microphone may move further away from the mouth, and/or move to one side. The microphone may also rotate. Any of these changes in position or orientation can reduce the ability of the microphone to detect speech clearly. Therefore, for some audio systems, it is desirable to provide a carrying system that is able to maintain certain of the system components or elements in a relatively stable or constrained position.

Figure 8:
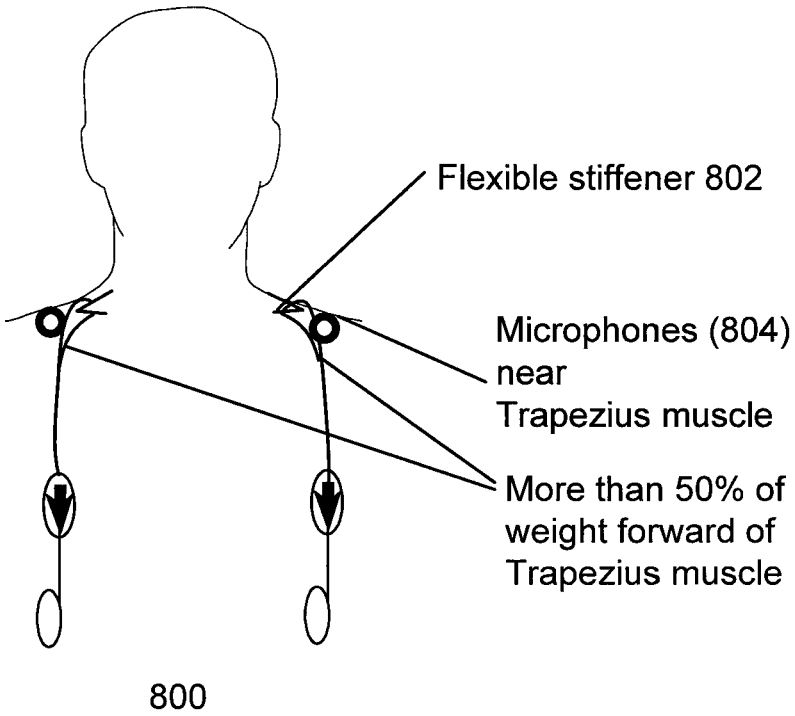
FIG. 8 is a diagram illustrating a Carrying System that may be used in implementing an embodiment of the present invention.

FIG. 8 is a diagram illustrating a Carrying System 800 that may be used in implementing an embodiment of the present invention. The figure illustrates a Carrying System similar to that shown in FIG. 1, and is provided with a flexible stiffener 802 towards the back of the neck. In some embodiments, it is designed such that at least 50% of the weight of the device is forward of the Trapezius muscle when worn by a typical user. The microphones 804 that are used within the body of Carrying System 800 are preferably placed near the Trapezius muscle where they are less likely to move in ways that degrade the performance of the audio system. The combination of these factors helps to ensure that Carrying System 800 remains appropriately in place around the neck, even when the user undertakes a variety of tasks. By keeping Carrying System 800 in a relatively stable position, the microphones in the body of the device are more likely to remain in their correct position relative to the user, and hence their noise cancelling ability is less likely to be diminished.

In some embodiments, the inventive audio system and associated methods, processes or operations for detecting the configuration or mode of use of the system, and for processing the relevant audio signals generated by or received by the components of the system may be wholly or partially implemented in the form of a set of instructions executed by a programmed central processing unit (CPU) or microprocessor. The CPU or microprocessor may be incorporated in a headset (e.g., in the Audio Processing System of FIG. 1), or in another apparatus or device that is coupled to the headset. In some embodiments, the computing device or system may be configured to execute a method or process for detecting a configuration or mode of use of the inventive audio system, and in response configuring elements of the system to provide optimal performance for a user. A system bus may be used to allow a central processor to communicate with subsystems and to control the execution of instructions that may be stored in a system memory or fixed disk, as well as the exchange of information between subsystems. The system memory and/or the fixed disk may embody a computer readable medium on which instructions are stored or otherwise recorded, where the instructions are executed by the central processor to implement one or more functions or operations of the inventive system.

Figure 9:
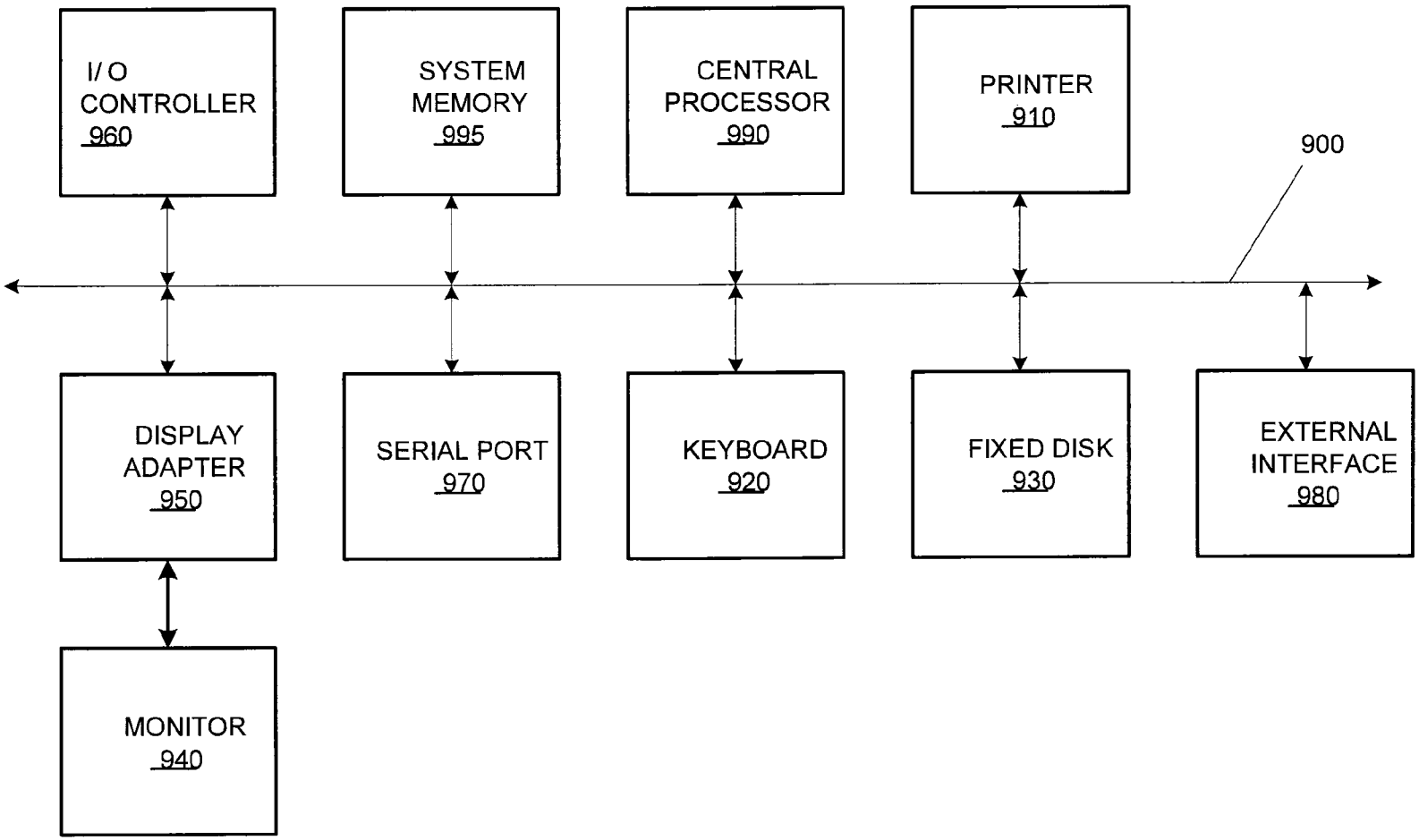
FIG. 9 is a block diagram of elements that may be present in a computing apparatus configured to execute a method or process to detect the configuration or mode of use of an audio system, and for processing the relevant audio signals generated by or received by the components of the system, in accordance with some embodiments of the present invention.

As an example, FIG. 9 is a block diagram of elements that may be present in a computing apparatus configured to execute a method or process to detect the configuration or mode of use of an audio system, and for processing the relevant audio signals generated by or received by the components of the system, in accordance with some embodiments of the present invention. Note that certain of the elements or subsystems may not be present in all embodiments. For example, if primarily implemented in a headset, certain of the input/output elements (e.g., printer, keyboard, monitor, etc.) would not typically be present. The subsystems shown in FIG. 9 are interconnected via a system bus 900. Additional subsystems such as a printer 910, a keyboard 920, a fixed disk 930, a monitor 940, which is coupled to a display adapter 950, and others are shown. Peripherals and input/output (I/O) devices, which couple to an I/O controller 960, can be connected to the computer system by any number of means known in the art, such as a serial port 970. For example, the serial port 970 or an external interface 980 can be used to connect the computer apparatus to a wide area network such as the Internet, a mouse input device, or a scanner. The interconnection via the system bus 900 allows a central processor 990 to communicate with each subsystem and to control the execution of instructions that may be stored in a system memory 995 or the fixed disk 930, as well as the exchange of information between subsystems. The system memory 995 and/or the fixed disk 930 may embody a computer readable medium.

It should be understood that the present invention as described above can be implemented in the form of control logic using computer software in a modular or integrated manner. Based on the disclosure and teachings provided herein, a person of ordinary skill in the art will know and appreciate other ways and/or methods to implement the present invention using hardware and a combination of hardware and software.

Any of the software components or functions described in this application, may be implemented as software code to be executed by a processor using any suitable computer language such as, for example, Java, C++ or Perl using, for example, conventional or object-oriented techniques. The software code may be stored as a series of instructions, or commands on a computer readable medium, such as a random access memory (RAM), a read only memory (ROM), a magnetic medium such as a hard-drive or a floppy disk, or an optical medium such as a CD-ROM. Any such computer readable medium may reside on or within a single computational apparatus, and may be present on or within different computational apparatuses within a system or network.

While certain exemplary embodiments have been described in detail and shown in the accompanying drawings, it is to be understood that such embodiments are merely illustrative of and not intended to be restrictive of the broad invention, and that this invention is not to be limited to the specific arrangements and constructions shown and described, since various other modifications may occur to those with ordinary skill in the art.

As used herein, the use of "a", "an" or "the" is intended to mean "at least one", unless specifically indicated to the contrary.

What is claimed is:

1. An audio system, comprising:

a first earpiece including a speaker;

a first configuration detection element configured to generate an output signal representative of whether the first earpiece is being used by a user;

a second earpiece including a speaker;

a second configuration detection element configured to generate an output signal representative of whether the second earpiece is being used by a user;

a system configuration determination element configured to receive the output signal generated by the first configuration detection element and the output signal generated by the second configuration detection element, and in response to generate an output signal representative of a configuration of the audio system being used by the user, the configuration consisting of speakerphone when neither earpiece is being used, left mono headset when only the first earpiece is being used, right mono headset when only the second earpiece is being used, and stereo headset when both earpieces are being used; and an audio signal processing module configured to process audio signals from an input source and provide an output to one or both of the first earpiece and the second earpiece, the audio signal processing module configured to access a database of thirteen audio processing parameters using the output signal and to select, based on the configuration, a single mode of use for the first earpiece, the second earpiece or both, and wherein the single mode of use and the thirteen audio processing parameters are selected from the group consisting of one of four modes for microphones in use, one of four modes for speakers in use, one of four modes for microphone gain, one of two modes for microphone ambient, only one mode for noise removal, one of three modes for wind noise removal, one of two modes for echo cancellation, one of two modes for microphone, only one mode for equalization, one of two modes for adaptive gain control, one of three modes for speaker equalization, one of two modes for speaker ambient noise removal, and one of four modes for speaker gain.

2. The system of claim 1, wherein the first configuration detection element is a microphone.

3. The system of claim 1, wherein the first and second configuration detection elements are microphones.

4. The system of claim 1, wherein the first configuration detection element is an accelerometer.

5. The system of claim 1, wherein the first and second configuration detection elements are accelerometers.

6. The system of claim 1, wherein the first configuration detection element is a conductive element arranged on the first earpiece.

7. The system of claim 1, wherein the first and second configuration detection elements are conductive elements arranged on the first and second earpieces.

8. The system of claim 1, further comprising the input source, wherein the input source is one or more of a microphone or a music player.

9. A method for operating an audio system, comprising:

determining a configuration of a first element of the audio system;

determining a configuration of a second element of the audio system;

determining a mode of use of the audio system based on the configuration of the first element and the configuration of the second element, the mode of use consisting of speakerphone when neither element is being used, left mono headset when only the first element is being used, right mono headset when only the second element is being used, and stereo headset when both elements are being used;

determining a parameter for the processing of an audio signal based on the mode of use of the audio system, wherein the mode of use and the parameter are selected from the group consisting of one of four modes for microphones in use, one of four modes for speakers in use, one of four modes for microphone gain, one of two modes for microphone ambient, only one mode for noise removal, one of three modes for wind noise removal, one of two modes for echo cancellation, one of two modes for microphone, only one mode for equalization, one of two modes for adaptive gain control, one of three modes for speaker equalization, one of two modes for speaker ambient noise removal, and one of four modes for speaker gain;

receiving an audio signal from an audio input source;

processing the received audio signal based on the parameter; and providing the processed audio signal as an output to a user.

10. The method of claim 9, wherein determining the configuration of the first element further comprises receiving a signal indicative of the configuration from a first configuration detection element.

11. The method of claim 10, wherein the first configuration detection element is one or more of a microphone, an accelerometer, or a conductive element arranged on the first element of the audio system.

12. The method of claim 9, wherein the audio input source is a microphone or a music player.

13. The method of claim 9, wherein providing the processed audio signal as an output to the user further comprises providing the processed audio signal to a speaker.

14. The method of claim 9, wherein the first element of the audio system is an earpiece that includes a speaker.

15. The method of claim 9, wherein the first element of the audio system and the second element of the audio system are each an earpiece that includes a speaker.

16. The method of claim 10, wherein the signal indicative of the configuration is indicative of the first element of the audio system being either in use by a user or not in use by the user.

17. An apparatus for operating an audio system, comprising:

an electronic processor programmed to execute a set of instructions;

an electronic data storage element coupled to the processor and including the set of instructions, wherein when executed by the electronic processor, the set of instructions operate the audio system by receiving a signal generated by a first configuration detection element;

determining a configuration of a first output device of the audio system based on the signal received from the first configuration detection element;

receiving a signal generated by a second configuration detection element;

determining a configuration of a second output device of the audio system based on the signal received from the second configuration detection element;

determining a mode of use of the audio system based on the configuration of the first output device and the configuration of the second output device, the mode of use consisting of speakerphone when neither configuration detection element is being used, left mono headset when only the first configuration detection element is being used, right mono headset when only the second configuration detection element is being used, and stereo headset when both configuration detection elements are being used;

determining a parameter for the processing of an audio signal based on the mode of use of the audio system, wherein the mode of use and the parameter are selected from the group consisting of one of four modes for microphones in use, one of four modes for speakers in use, one of four modes for microphone gain, one of two modes for microphone ambient, only one mode for noise removal, one of three modes for wind noise removal, one of two modes for echo cancellation, one of two modes for microphone, only one mode for equalization, one of two modes for adaptive gain control, one of three modes for speaker equalization, one of two modes for speaker ambient noise removal, and one of four modes for speaker gain;

receiving an audio signal from an audio input source;

processing the received audio signal based on the parameter; and providing the processed audio signal as an output to a user.

18. The apparatus of claim 17, wherein the first and second configuration detection elements are each one or more of a microphone, an accelerometer, or a conductive element arranged on the output devices of the audio system.

* * * * *